United States Patent [19]

Laux

[11] 4,387,516

[45] Jun. 14, 1983

[54] UNIVERSAL INSOLE

[75] Inventor: Joseph J. Laux, Scottsdale, Ariz.

[73] Assignee: L & A, Inc., Phoenix, Ariz.

[21] Appl. No.: 218,532

[22] Filed: Dec. 22, 1980

[51] Int. Cl.[3] ..... A43B 13/38

[52] U.S. Cl. ..... 36/43; 36/8.4; 33/3 R; 33/5

[58] Field of Search ..... 36/43, 44, 1, 8.4; 33/3 R, 3 C, 3 A, 3 B, 5

[56] References Cited

U.S. PATENT DOCUMENTS

| | | | |
|---|---|---|---|
| 1,144,291 | 6/1915 | Boyer | 36/43 |
| 2,464,571 | 3/1949 | Gardner | 36/43 X |
| 2,835,908 | 5/1958 | Mott | 36/8.4 X |
| 3,143,812 | 8/1964 | Bittner | 36/8.4 X |

*Primary Examiner*—James Kee Chi

*Attorney, Agent, or Firm*—Gregory J. Nelson

[57] ABSTRACT

A universally sized insole of a cushioned material having pattern markings printed therein for trimming to the appropriate size. Men's and women's size markings are oppositely displaced on the insole to minimize interference between the two to facilitate trimming.

4 Claims, 2 Drawing Figures

UNIVERSAL INSOLE

The present invention relates to insoles for footwear and more particularly relates to an insole adapted for universal sizing.

It is common practice to place insoles of various types in footwear for improved comfort. For example, cushion insoles of various materials such as leather, cloth, sponge rubber and polymeric synthetic materials are available and are generally provided in various sizes. The user must select a pair of insoles corresponding to the size of the user's feet. Generally, these insoles are pre-packaged in pairs. More recently insoles have been developed of various cushioned materials such as latex foam, some impregnated with activated charcoal or other filtering material, which are printed with a pattern and are adapted to be cut to the required size by the user.

Briefly, the present invention provides an improved insole of the universal fit type which is trimmed to the proper size by the user. The advantage of a universal insole resides in manufacturing economies as well as convenience to the user. The user can custom fit the insoles which is particularly advantageous in a situation where the user may have a slight difference in the size of each of the user's feet. The present invention provides an insole of suitable material such as a latex or polymeric foam which is provided or inscribed with pattern indicia and markings indicating various men's and women's foot sizes along which the user trims to the required size. The pattern indicia and markings indicate a multiplicity of sizes for both men and women. The markings indicating women's sizes are arranged having a common heel or toe line on the indicia pattern so that substantially all of the trimming selection is made at the opposite end of the pattern. Similarly, the pattern markings for men's sizes are arranged on the insole having a common heel or toe portion so that substantially all of the trim selection is done at the opposite end of the pattern.

Figure 1:
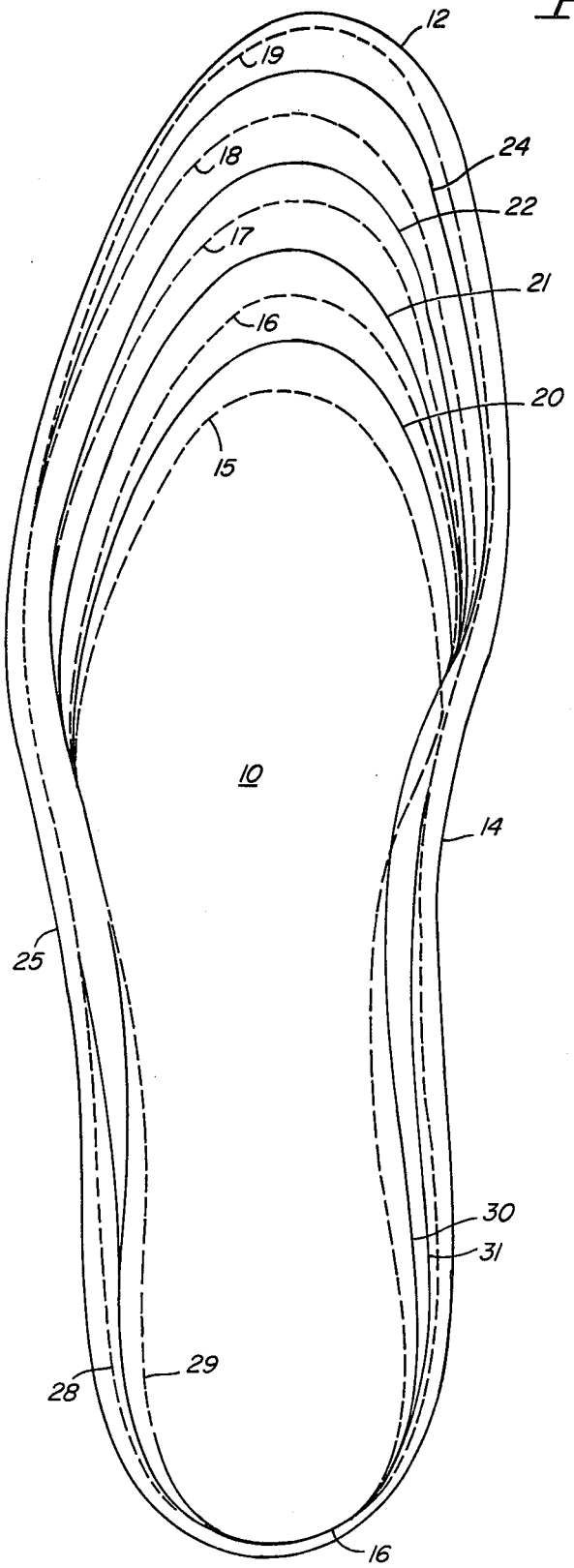
FIG. 1 (PRIOR ART)
Figure 2:
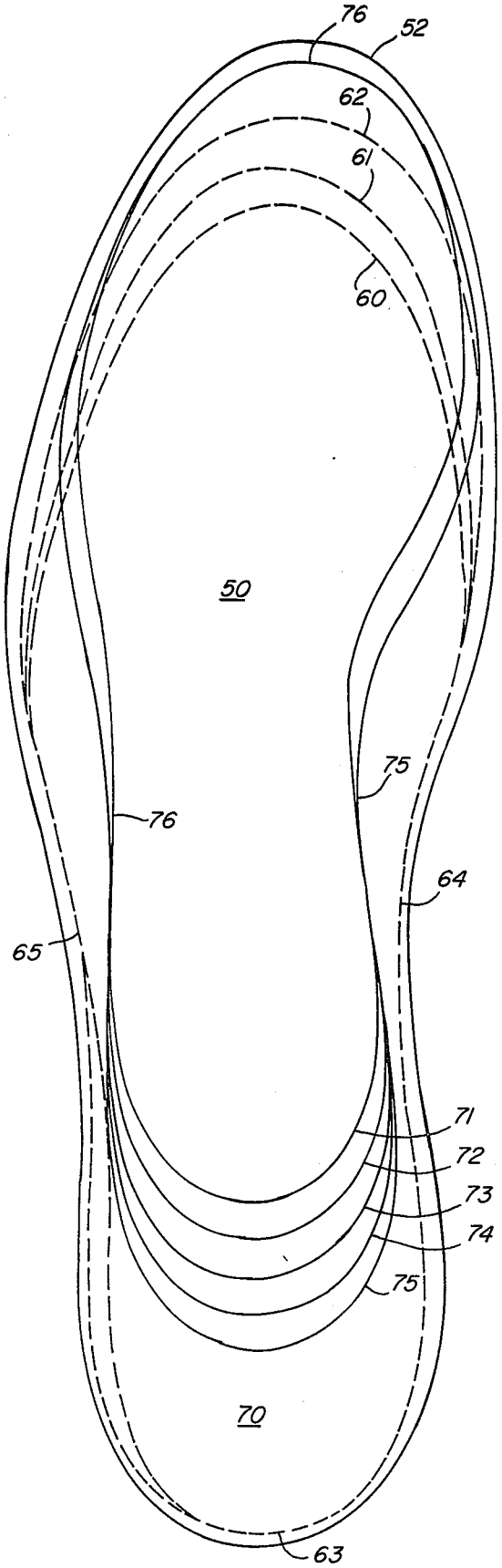

Briefly, the above and other objects and advantages of the present invention will become more apparent from the following description, claims and drawings in which:

FIG. 1 is a plan view of a footwear insole of the type utilized in the prior art; and FIG. 2 is a plan view of an insole incorporating the pattern indicia of the present invention.

Turning now to the drawings, FIG. 1 illustrates the prior art insoles of the type sometimes designated as "one size fits all" insole. These insoles are designed for general universal fit and are trimmed to size by the user. The insole 10 may be of any suitable material having a peripheral shape generally conforming to the shape of a human foot having arcuate toe and heel sections 12 and 16 and a convergent medial arch section 14 and a lateral portion 25. The upper surface of the insole 10 is imprinted with a number of pattern guidelines corresponding to various shoe sizes. For example, dotted lines 15, 16, 17, 18 and 19 represent certain selected foot sizes as for example women's size 5, 7, 8, men's 7 and women's 9, and men's 9 and men's 11, respectively. Similarly, solid lines 20, 21, 22 and 24 in the toe section 12 represent guidelines for trimming to various shoe sizes as for example women's size 6, 8, men's 8 and women's 10, and men's 10 respectively. The various pattern lines converge and extend rearwardly through the arch at lines 28, 29, 30 and 31 to a common guideline 16 in the heel area. Using these printed guidelines on the insole, the user trims the insole with a scissors or other cutting instrument to the proper size. A substantial number of trim lines, particularly in the toe area and the medial and lateral area of the insole makes it difficult for the user to determine and follow the proper cutting line. If, for example, the insole is trimmed at a size line too small, the insole will not be suitable for use.

FIG. 2 represents the insole according to the present invention which is generally designated by the numeral 50 having a toe portion 52, heel portion 70 and lateral and medial sides 76 and 75 in the general outline of a human foot. The insole may be constructed of any suitable material for this purpose such as a foam latex of polymeric material with a laminae of terry cloth or other absorbent material. For purposes of illustration insole 50 is shown representing a single foot, it being obvious that a pair would consist of one insole as shown and another which is the mirror image of the one shown. One surface of the insole 50 is provided with pattern markings which the user may follow to cut the insole to the proper size. The pattern generally designated by the numeral 50 and may be printed, silk screened or otherwise applied to a surface of the insole 50. The pattern which consists of representations of various sizes of the human foot has a plurality of guidelines which are shown in solid representing various sizes for women. The solid lines all have a coincident or common area 76 at the toe 52 of the insole. The solid lines extend rearwardly along the medial and lateral area at lines 75 and 76 respectively, terminating at the heel portion of the insole generally designated by the numeral 60. The heel portion of the pattern comprises a plurality of lines 72 to 75 each being generally arcuate and being progressively spaced-apart to represent various shoe sizes. As for example, line 71 represents guide line or trim line for women's size 6, line 72 represents a women's size 7 and so on. Thus substantially all of the trimming necessary for cutting the insole to correspond to a woman's footsize is accomplished along the mid area and in the heel area 70. This is easily accomplished since there is a minimum of interference from intersecting lines representing other sizes.

Similarly, men's sizes are indicated in dotted lines which all coincide at common arcuate heel line 63 in the heel area 70 of the insole. The pattern lines extend along the insole at lines 64 and 65 and forwardly terminate at lines 60, 61 and 62 in the toe area of the insole. The men's pattern lines thus have a common heel area and substantially all of the trimming is done along sides of the pattern and at the toe trim lines 60 to 62. The toe trim lines are in an area which again is relatively free from confusing interference with trim lines representing the various women's sizes.

The principal advantage of the present invention is the clarity with which the trim pattern markings are presented to the user. The markings are arranged so that all of the men's sizes are represented by markings or guidelines of one type as for example solid or dotted line. In contrast, the markings for women's sizes are represented by other markings as for example, contrasting solid or dotted lines. Further, the womens' sizes are displaced either forwardly or rearwardly on the insole and the trim lines representing the men's sizes are oppositely displaced either forwardly or rearwardly on the insole to minimize overlapping and to simplify trimming operation for the user.

As pointed out above, the markings or indicia used may vary and dotted and solid lines are shown as being typical. Further, the material of the insole may vary and may be a composite or laminate structure of several materials. Also the respective markings for men and women's sizes could be placed on opposite sides of the insoles.

It will be apparent to those skilled in the art to make various changes, alterations and modifications to the unique insole described herein. To the extent that these changes, alterations and modifications do not depart from the spirit and scope of the appended claims, they are intended to be encompassed herein.

I claim:

1. A universally sized insert for footwear comprising:

(a) an insole having the general shape of a human foot having opposite surfaces, a heel portion, a toe porton and opposite lateral and medial sides;

(b) a first set of pattern markings on one of said surfaces representing a plurality of foot sizes, each of said first set of pattern markings being in the general configuration of a human foot, said first set of markings having a common toe portion and being displaced on said insole toward the toe portion of said insole and having a plurality of generally arcuate sections in the heel area representing different sizes;

(c) a second set of contrasting markings on the said one of said surfaces representing a plurality of foot sizes, each of said second set of markings being in the general configuration of a human foot, and second set of markings having a common heel portion and being displaced on said insole toward the heel of said insole and having a plurality of generally arcuate sections in the toe portion all representing the different shoe sizes thereby permitting the user to trim the insert to the desired size by trimming at a preselected marking.

2. The insert of claim 1 wherein one of said sets represents men's sizes and the other of said sets represents women's sizes.

3. The insert of claim 1 wherein said insole comprises a cushion material.

4. The insert of claim 3 wherein said cushion material is a laminate structure.

* * * * *